US005163318A

United States Patent [19]

Schatz

[11] Patent Number: 5,163,318

[45] Date of Patent: Nov. 17, 1992

[54] METHOD OF MONITORING FOR CORROSION AND A SYSTEM FOR PERFORMING THE METHOD

[76] Inventor: Oskar Schatz, Waldpromenade 16, D-W8035 Gauting, Fed. Rep. of Germany

[21] Appl. No.: 706,769

[22] Filed: May 29, 1991

[30] Foreign Application Priority Data

May 30, 1990 [DE] Fed. Rep. of Germany ..... 4017451

[51] Int. Cl.[5] ..... G01M 19/00

[52] U.S. Cl. ..... 73/118.1

[58] Field of Search ..... 73/118.1, 40.5 R, 118.1; 340/449, 451; 422/53; 436/148, 6

[56] References Cited

U.S. PATENT DOCUMENTS 4,633,213 12/1986 Venema ..... 340/449

*Primary Examiner*—Jerry W. Myracle

*Attorney, Agent, or Firm*—Harness, Dickey & Pierce

[57] ABSTRACT

In order to monitor a sealed or sealable space filled more particularly with a liquid for corrosion, more particularly in a heating and cooling circuit comprising a heat storage device in a motor vehicle the pressure in the sealed space is measured and a pressure dependent indication, more particularly in the form of an alarm signal, is produced when a threshold value is exceeded.

14 Claims, 1 Drawing Sheet

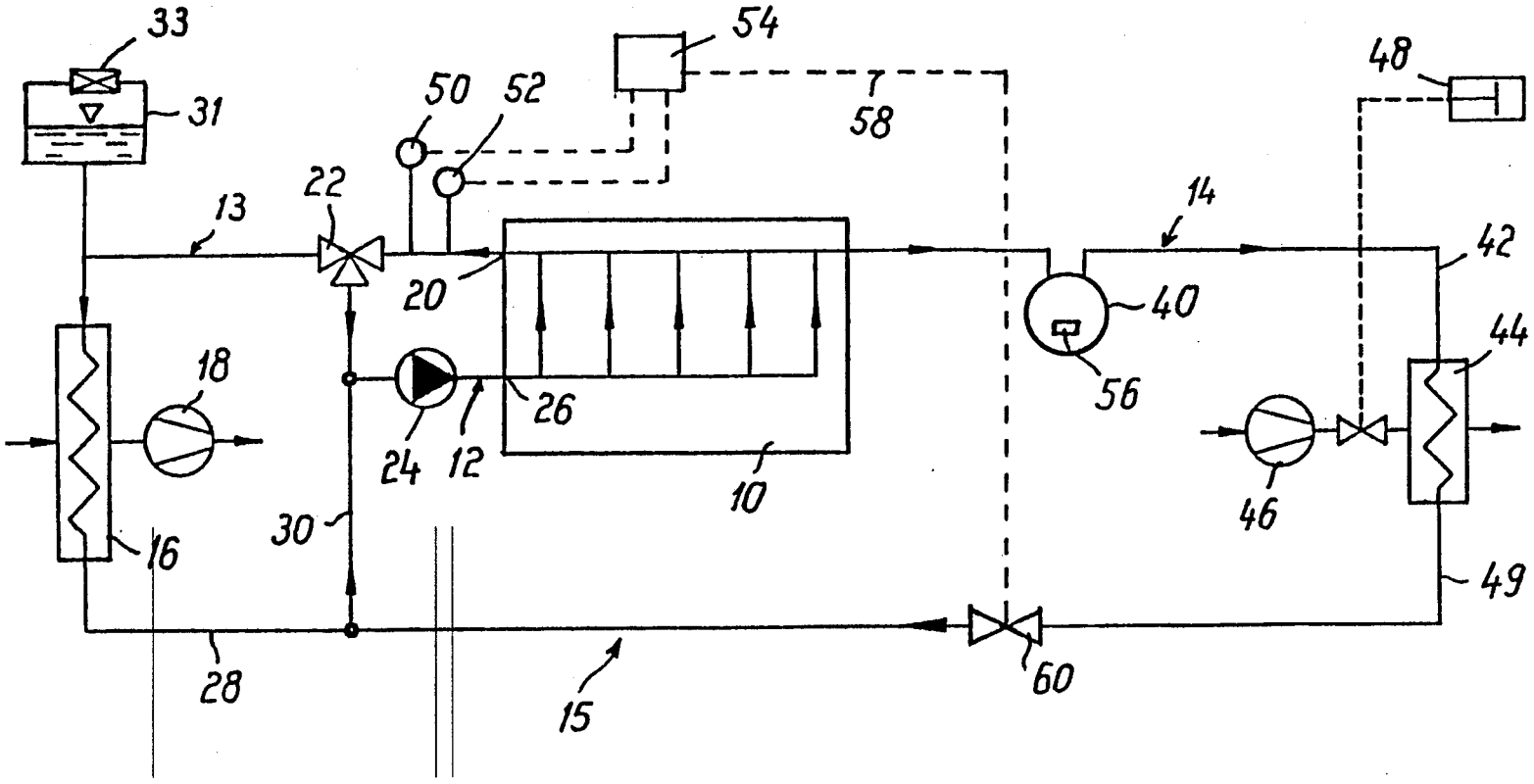
48
42
44
49
46
14
40
56
60
58
54
10
15
52
50
26
20
12
24
22
30
13
18
28
33
31
16

METHOD OF MONITORING FOR CORROSION AND A SYSTEM FOR PERFORMING THE METHOD

BACKGROUND OF THE INVENTION

The invention relates to a method of monitoring for corrosion in sealed and more particularly liquid-filled spaces such as heat storage means and more specifically heating and cooling circuits of motor vehicles and to a system for performing the method.

Without any limitative intent, the invention is to be described with reference to such heating and cooling circuits, which constitute a preferred field of application of the invention, since they are equally suitable also for use in other sealed or sealable spaces where there is a corrosion hazard, such as for instance heat pipes or boilers. The invention may find application in all spaces in which there is a danger of corrosion and more particularly which are substantially filled with a liquid or contain a material which changes between different phases, more particularly between the liquid and the gaseous phase, or a gaseous material having moisture therein.

Modern heating and cooling circuits are hermetically sealed so that in normal operational circumstances the heat transfer medium, which circulates in the circuit and normally contains water, is not able to escape as vapor when its temperature exceeds its boiling point. For extreme situations a pressure relief valve is provided.

The heat transfer medium conveys the heat within the engine, from the engine to the vehicle heating system and from the engine to the cooling system. Heat storage means, more particularly in the form of latent heat storage means are incorporated in such heating and cooling circuits in order to store engine heat for operational conditions in which there is a thermal deficit, for instance for starting from cold.

The storage material utilized for storing with a high energy density is frequently such as to attack metals, which are employed in heating and cooling circuits, for example aluminum and copper. In the case of leakage of the heat storage material into the heat transfer medium it is possible for the escaping storage material to circulate and to cause corrosion, decomposition and the like so that respective damage will be caused.

Since such corrosion is normally accompanied by the formation of gaseous hydrogen, the pressure within the sealed heating and cooling liquid circuits will increase so that the hoses normally utilized in a part of the circuit will stretch, this leading to difficulties in the regulation of the level and may finally cause the pressure relief valve to open with the consequent loss of the heat transfer medium so that as a further consequence the engine has to be put out of operation.

Since the leakage of the heat storage material results in chemical and physical changes in the heat transfer medium, attempts have been made to detect such changes and to use them as leakage indicators. In this respect ionization and changes in the electrical conductivity are more particularly to be mentioned. Such measurements are however only possible with a comparatively large amount of apparatus complexity and are not necessarily conclusive, because the respective readings are inherently subject to large variations and because the sensors may readily be fouled. Furthermore the concentrations of leaked material are subject to considerable local variations so that the location of such sensors is made even more elaborate.

SHORT SUMMARY OF THE PRESENT INVENTION

Accordingly one object of the invention is to devise a method of monitoring for corrosion in sealed spaces and more particularly in spaces filled with liquid, such as heating and cooling circuits, including heat storage means, of motor vehicles, which are such that the method may also be utilized in vehicles economically in order to promptly detect and quickly indicate leakage in such a manner that no damage results and furthermore the possibility of a false alarm being given is reduced to a minimum.

In order to achieve these or other objects to be seen from the following account and from the drawing, in the invention the pressure in the sealed space is measured and a pressure dependent indication thereof is produced; preferably an indication is provided if a threshold is exceeded.

Since the release of hydrogen gas connected with the corrosion leads to a marked increase in pressure and even in the case of quantities of hydrogen as low as a few milligrams causes a distinct increase in pressure, in a sealed space and this pressure occurs at all positions within the space, a simple detection of corrosive leakages is possible.

A still further advantage of the measurement of the pressure is that other conceivable causes for a distinct increase in pressure in such heating and cooling circuits are also indications of considerable damage or of hazardous operational conditions, as for instance damage in the cylinder head gasket, overheating of the engine, etc.

In accordance with a further possible development of the invention for monitoring for corrosion in liquid containing spaces the threshold pressure is above a vapor pressure occurring in the permissible operational range, but is under the opening pressure of any pressure relief valve present. Consequently when the indication occurs that the threshold value has been exceeded one may be certain that there is a condition outside the permissible operational range. In the case of monitoring for corrosion in heating and cooling circuits of motor vehicles including heat storage means, it is possible for the threshold value to be 3 bar absolute.

A further possible feature of the invention for monitoring for corrosion in spaces filled with liquid is such that in addition to the pressure the temperature of the liquid is measured and the indication is suppressed, when the liquid temperature reaches or exceeds the boiling point. In the case of low temperatures, for instance under 90° to 100° C., the sealed space to be monitored for corrosion will as a rule be substantially at atmospheric pressure so that even an increase in pressure of 0.5 bar will be clear indication of an operational disturbance, for instance corrosion or a leak in the cylinder head of the engine, has occurred for which reason in the case of this embodiment of the invention a relatively sensitive monitoring for corrosion is possible. In order to ensure that when the boiling point is exceeded and there is an accompanying development of vapor pressure no signal is produced in the absence of corrosion or any other unusual condition, the indication is suppressed in this case. In the case of monitoring for corrosion in heating and cooling circuits comprising a heat storage means in motor vehicles it is preferred for the threshold pressure to be at 1.5 bar absolute and for the alarm to be suppressed as from a certain temperature of 90° C. upwards so that even in the case of journeys over alpine passes the boiling temperature, which will then be lower, will not cause any signal.

In keeping with yet another particularly convenient form of the invention, in addition to the pressure the temperature is measured and the threshold pressure is altered in a manner dependent on the temperature so that it is respectively a certain amount above the pressure corresponding to the temperature during trouble-free operation.

In accordance with a further advantageous form of the invention for motor vehicle heating systems when the threshold pressure in the heating circuit is exceeded a valve is closed and hence the circulation of the heat transfer medium through the heat storage means is halted.

In accordance with a further possible development of the invention a closed system for performing the method in accordance with the invention is so designed that directly adjacent to a potential leakage site of the corrosive materials a small quantity of readily corroding material is positioned in the system. If corrosion the takes place the emerging corrosive material will at once come into contact with this readily corroding material and will cause an increase in the pressure, which will produce the alarm in the form of a warning signal, before the emerging corrosive material is able to reach sensitive part of the system.

In a system in the form of a heating and cooling accuracy comprising at least one heat storage means for motor vehicles it is possible in accordance with a further convenient embodiment of the invention for the readily corroding material to be positioned within the heat storage means.

The readily corroding material, which is only provided for the purpose of firstly being attacked by the corrosive material which escapes in the event of there being a leak and consequently produces the increase in pressure which leads to the warning signal, and which therefore is in the following referred to as the detector material and has a weight of only a few grams and may for instance be in the form of a piece of wire.

A further convenient feature of the invention with a system in the form of a heating and cooling circuit provided with at least one heat storage means, for motor vehicles, is such that in the heating circuit there is a valve adapted to be closed in a manner dependent on a signal which is so arranged that it is able to be closed by the alarm signal occurring when the threshold pressure is exceeded so that the flow through the heat storage means and hence the circulation of the corrosive material is halted.

The invention will now be described in more detail with reference to the accompanying drawing, which shows a working embodiment in the form of a cooling and heating circuit of a motor vehicle provided with a heat storage means.

In the drawing reference 10 denotes an engine with an engine circuit 12, a cooling circuit 13 and a heating circuit 14, which together are referred to as a heating and cooling circuit 15. The cooling circuit 13 comprises a radiator 16 with a radiator fan 18. The heat transfer medium emerging at 20 from the engine 10 firstly passes to a thermostat-controlled three-way valve 22. If the heat transfer medium has not so far attained the working temperature, it is directly diverted at the three-way valve 22 to a water pump 24 and passed by the latter at 26 back to the engine 10, this being termed the engine circuit. When the heat transfer medium has reached the desired working temperature, the three-way valve 22 interrupts the direct connection to the water pump 24 and the heat transfer medium is passed via the cooler 16, from which it passes via the cooler return circuit 28 and the connection duct 30 to the water pump 24 and is again passed through the engine 10. An equalizing container 31 with a pressure relief valve prevents any excessive rise in pressure.

A latent heat storage means 40 is then connected with the engine 10, whose chambers in the flow of the liquid contain a potentially corrosive material. The heat storage means 40 is connected via the heating circuit 42 with a heating heat exchanger 44, with which a heating blower or fan 46 is associated which is able to be adjusted by means of heating adjustment means 48 to be in accordance with the respective requirements. A heating return means 49 extends from the heating heat exchanger 44 to the connecting duct 30 and from the latter via the water pump 24 back to the engine 10.

Between the engine 10 and the three-way valve 22 a pressure sensor 50 and a temperature sensor 52 are associated with the heating and cooling circuit 15, such sensors being adapted to respond to the pressure and the temperature of the heat transfer medium in the heating and cooling circuit 15 and to send a signal to an indicating unit 54, which may be provided with an alarm device, in the dash board (not illustrated) of the vehicle.

The arrangement of the two sensors 50 and 52 adjacent to the thermostat controlled three-way valve 22 is selected because normally the temperature sensor is positioned adjacent to the thermostat.

Since the pressure is equal throughout the entire sealed system is always the same it is also possible to select another position for the pressure sensor 50, for instance in the equalizing container 31, where it is particularly well protected against dirt.

A few grams of a detector material 56 are arranged in the heat storage means 40, such material being for instance a piece of aluminum or copper wire with a mass of approximately 1 gram.

Leakage of the heat storage material into the heating and cooling circuit 15 will lead to corrosion of materials which are liable to corrosion and this leads to the formation of gaseous hydrogen. Since the system is hermetically sealed off, the formation of hydrogen results in an increase in the pressure within the system, and such rise may be measured at the pressure sensor 50. The reading is indicated at the indicating unit 54, the arrangement being preferably such as to prevent spurious readings in such a manner that one indication, preferably in the form of an optical and/or acoustic alarm signal, is only produced, when a predetermined threshold pressure is reached or is exceeded.

Since the detector material 56 is arranged adjacent to the heat storage means 40, this material is firstly attacked and therefore entails an increase in the pressure in the system, before the corrosive heat storage material is able to further operate in the heating and cooling circuit. When the indicating unit 54 responds to a temperature rise to or past the threshold pressure, it is possible for a control signal to be supplied via a conductor 58 to a valve 60 in the heating and cooling circuit 15 in order to close this valve and therefore to prevent the corrosive material from reaching other parts of the heating and cooling circuit.

In order to still further localize the position which is exposed to corrosion, it is possible to divide up a system to be monitored for corrosion—which is more particularly a large or relatively elaborate system—into a plurality of mutually separated parts sealed from each other, of which each is provided with its own pressure sensor. In the case of piping arrangements the sealing means between the individual parts is preferably by means of shut off valves. For such an analytical examination it is generally necessary for the system to be put out of operation, because the sealing means interrupts the operational circuit.

In order to perform an examination of corrosion damage in open systems the latter may be hermetically sealed off.

I claim:

1. In a method of monitoring a sealed space for corrosion in a heating and cooling circuit of a motor vehicle having a heat storage means, the method comprising: measuring the pressure in the sealed space and providing an indication which is dependent on pressure.

2. The method as claimed in claim 1, and providing said indication when a threshold pressure is exceeded.

3. The method as claimed in claim 2 for monitoring a heating and cooling circuit comprising a heat storage means in a motor vehicle for corrosion, and shutting a valve upon exceeding the threshold pressure in the heating circuit.

4. The method as claimed in claim 1 for monitoring a liquid-filled space for corrosion, wherein threshold pressure being above the vapor pressure occurring in the permissible operational condition but under the opening pressure of any pressure relief valve present.

5. The method as claimed in claim 4 for monitoring a heating and cooling circuit comprising a heat storage means in a motor vehicle for corrosion, said threshold pressure being at 3 bar absolute.

6. The method as claimed in claim 4 for monitoring a heating and cooling circuit comprising a heat storage means in a motor vehicle, said threshold pressure being 1.5 bar absolute and said indication being suppressed as from a predetermined upper temperature limit of 90° C. upwards.

7. The method as claimed in claim 1 for monitoring a liquid-filled space for corrosion, wherein temperature of the liquid being measured in addition to the pressure thereof, said indication being suppressed when the temperature of the liquid reaches or exceeds the boiling point.

8. The method as claimed in claim 1, wherein in addition to the pressure, temperature is measured and threshold pressure is so modified in a manner dependent on the temperature that it respectively corresponds to a pressure, which is a predetermined amount above the respective pressure corresponding to the temperature during trouble-free operation.

9. The method as claimed in claim 1, wherein the sealed space is produced by the closing of a valve of an otherwise open space during the examination for corrosion.

10. The method as claimed in claim 1 for analytical corrosion monitoring, in a large system, wherein the system is subdivided by sealing off into a plurality of compartments each provided with a pressure sensor and the pressure in each of these spaces is measured.

11. A sealed system for monitoring a sealed space for corrosion, said system comprising:

a heating and cooling circuit having a sealed space;

a heat storage means associated with said heating and cooling circuit;

a corrosive material in said heating circuit;

a small quantity of readily corroding material positioned in the circuit adjacent to a point at which the corrosive material is liable to escape;

means for measuring pressure in said sealed space, said measuring means associated with said sealed space; and means for providing an indication that leakage has occurred dependent on pressure.

12. The system as claimed in claim 11 wherein said readily corroding material is arranged in the heat storage means.

13. The system as claimed in claim 12, wherein the readily corroding material has a weight limited to a few grams.

14. A sealed system for monitoring a plurality of sealed spaces for corrosion, said system comprising:

a heating and cooling circuit having a sealed space which is able of being subdivided by compartment means into a plurality of individual sealed spaces;

a heat storage means associated with said heating and cooling circuit;

a corrosive material in said heating circuit;

corroding material means adjacent a point at which the corrosive material is liable to escape;

means for measuring pressure in each of said plurality of sealed spaces, said measuring means associated with said sealed spaces; and means for providing an indication that leakage has occurred dependent on pressure.

* * * * *